US005677509A

United States Patent [19]

Potvin et al.

[11] Patent Number: 5,677,509

[45] Date of Patent: Oct. 14, 1997

[54] BEDDING AND TRAINING ROUND FOR MORTARS

[75] Inventors: Marc Potvin, Lachenaie; Rolland Belzil, Verchères, both of Canada

[73] Assignee: SNC Inudstrial Technologies Inc., Quebec, Canada

[21] Appl. No.: 525,063

[22] Filed: Sep. 8, 1995

[51] Int. Cl.[6] ..... F42B 8/14

[52] U.S. Cl. ..... 102/498; 102/445; 102/529

[58] Field of Search ..... 102/498, 445, 102/529, 513, 395, 366, 367

[56] References Cited

U.S. PATENT DOCUMENTS

| | | | |
|---|---|---|---|
| 2,112,758 | 3/1938 | Blacker | 102/367 |
| 3,463,047 | 8/1969 | Germershausen | 102/529 |
| 4,109,579 | 8/1978 | Carter | 102/513 |
| 4,549,487 | 10/1985 | Jensen | 102/498 |
| 4,711,180 | 12/1987 | Smolnik | 102/445 |
| 5,375,529 | 12/1994 | Knight, Jr. et al. | 102/513 |

FOREIGN PATENT DOCUMENTS

| | | | |
|---|---|---|---|
| 2538892 | 7/1984 | France | 102/513 |
| 2192696 | 1/1988 | United Kingdom | 102/445 |

*Primary Examiner*—Stephen M. Johnson

[57] ABSTRACT

A mortar bedding or training round has a canister filled with a heavy, dispersible filling and a sidewall that will rupture after firing of the round. The canister sleeve may be dimensioned to provide an expansion gap within the barrel, allowing the canister sidewall to partially expand upon firing, weakening it for subsequent rupture upon leaving the mortar barrel. Such a round can bed a mortar without launching a projectile to a high altitude where it might be detected.

20 Claims, 3 Drawing Sheets

BEDDING AND TRAINING ROUND FOR MORTARS

FIELD OF THE INVENTION

This invention relates to a round to be fired in a mortar to seat or "bed" the mortar base plate on the ground without raising a projectile to a height that would expose the firing team to increased risk of detection. It is also directed to a "training" mortar round that closely simulates a real firing while reducing the training safety zone or template.

BACKGROUND OF THE INVENTION

In the operation of a military mortar, a mortar shell is fired from a firing tube or barrel that is supported by a base plate that rests on the earth. The elevation of the barrel is controllable by adjusting its angle with respect to supporting struts extending from the barrel to the ground.

If the ground under a mortar is soft, the first firing will compact the base plate into the soil. Any change in the position or orientation of the base plate will affect the angle at which the firing tube is supported, hence the accuracy of subsequent rounds. It is only when the base plate has been stabilized so as to not substantially change in its position or angular orientation after a firing that the mortar can be reliably adjusted to control its aiming point.

It is customary in firing a mortar to fire an initial round without reference to spotting the point of impact of the initial round for calibration of the aiming of the mortar. Customarily calibration and adjustment of the aim of the mortar only commences after the initial round is fired. The first round serves, therefore, only to "bed" the mortar, preparatory to more controlled subsequent firings.

In modern combat mortar teams are subject to retaliating fire. Radar systems exist which can trace the trajectory of a shell, estimating its point of origin. Once this is done, return fire can be focused on this estimated location.

It is customary under these circumstances for a mortar team to change its position after a relatively short time following the firing of its first shell. The time available before this should occur can be as short as a few minutes. It has been found that a response by an opponent cannot normally occur in a shorter time. As radar controlled retaliatory systems become more responsive, this time delay will tend to be decreased.

With such a short time window within which to engage in offensive fire, the discharge of a bedding round consumes a valuable portion of the time available before a mortar team must shift its location. It would be desirable to provide a means for bedding a mortar which would not provide an opponent with an initial, ineffectually aimed shell trajectory upon which to mount retaliatory fire.

It would also be desirable to provide a training round for use by mortar teams wherein the round consumed is less costly than a normal mortar round.

It is with these objects in mind that the following invention has been conceived.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

According to the invention, a mortar round is provided that has, in lieu of the customary projectile, a contained mass of flowable and dispersible material that, upon being fired from a mortar will disperse at a low altitude. The mass contained within the round should be sufficient to provide a reactive thrust on the mortar base plate that will simulate the firing of a live service round.

More particularly, such a round may be provided that includes:

(1) launching means for the round which, in turn may include:
  (a) an ignition tube;
  (b) a primer receptacle at an access to the ignition tube;
  (c) guidance fins coupled to the ignition tube;

(2) a canister mounted through a seat on the ignition tube containing a dispersible filling and having a disintegratable sleeve defining the sidewall of the canister mounted on said seat, there being a reduced strength portion within said sidewall which provides a preferred failure path or region within said sidewall;

(3) a flowable filling having mass positioned within the sleeve wherein:

(i) the mass of the filling is sufficient to simulate firing or actually bed a mortar upon firing; and (ii) the reduced strength portion of said sidewall is sufficiently weakened upon firing so as to cause said canister to rupture upon leaving the muzzle of a mortar barrel thereby releasing the filling for dispersion into the surrounding space.

One means of achieving this is to provide the sleeve with a sidewall whose internal structure has been pre-conditioned to fail upon the firing of the mortar by reason of the presence of the preferred failure path or region within the sidewall. Reduced strength portions may be provided, for example, by the presence of thinned grooves or other weakened areas in the sidewall that provide the failure path or region. With the failure of such internal structure, the sleeve, with its filling, is held together integrally by the mortar launch tube or barrel while the round is within such tube, rupturing only after leaving the muzzle of the mortar barrel. This can be achieved by dimensioning the sleeve with a diameter that is less than the bore diameter of the launch tube by an amount that constitutes an expansion gap. Upon firing of the mortar, the inertial forces of acceleration (being on the order of 7000 G's) cause the flowable filling to apply an expansive force at the lower end of the sleeve, breaking the internal bonds within the sleeve. With the bonds broken the sleeve expands to the limit provided by taking-up the expansion gap. Thereafter further expansion is prevented by the confinement of the launch tube until the round leaves the mortar barrel.

A suitable sleeve can be formed by spirally wrapping strips of paper or thin plastic sheet that are bonded as by gluing, welding or other suitable means with each other, forming portions within the body of the sleeve wall that are thinned and will break under the stress of firing.

By selection of an appropriate wall thickness and paper strength the sleeve wall may be fabricated to lose most or all its structural integrity by the breaking of its internal bonds upon firing. Such a round may thereby be designed to rupture directly or shortly after leaving the muzzle of the launch tube, releasing the filling to disperse in the local area of the launch site.

A delayed release of the filling can be provided by providing the sleeve with a wall that ruptures in two stages.

The first stage occurs when the bonds within the sleeve are only partially broken on firing. For example, the bonds within the lower end of the sleeve may be broken on firing, the upper portion of the sleeve remaining integral. This effect can occur naturally, or can be enhanced by providing an air gap above the filling in the sleeve so that only the portion of the sleeve below the air gap experiences expansive forces upon firing. Alternately, the sleeve wall may be constructed of a material that is only partially ruptured when the sleeve wall expands to occupy the expansion gap.

The second stage of rupture may then occur after the round has left the mortar muzzle. From that moment on, the round is rapidly decelerating under the effect of the drag created by the air. The nose-end of the bedding round can be made non-streamlined to increase this effect.

As the outer sleeve of the round commences to decelerate, the differential forces arising from the separation of the centre of pressure from the centre of mass of the canister will cause it to tumble, bursting open the sleeve sidewall. The resulting dispersal of the filling will thereby be delayed by the time it takes the canister sidewall to rupture completely.

Such a round may be provided with a variety of fillings such as powdered metals, clays or even a liquid such as water. The filling need only be self-dispersing upon the rupturing of the sleeve sidewalls. It should also be present in a quantity that provides enough mass to obtain the "bedding" effect.

By providing a filling that is flowing, the quasi-hydrostatic effect of generating an expansive force which, when applied to the sleeve walls upon firing will rupture the sleeve wall's integrity, can be created.

Suitable materials for the sleeve wall include plastic sheeting and paper. Paper has the advantage that it has little tendency to become brittle under very cold conditions. Plastic has the advantage that it is relatively impervious to moisture and can maintain its integrity when wet. With certain fillings, e.g. iron, it may be necessary to provide a moisture barrier, or a desiccant, to reduce the risk that the filling will become internally bonded, as by rusting. For this reason, it may be desirable to treat a paper-walled sleeve with a moisture barrier coating.

This same round can be utilized as a training round. The mere firing of a round that provides the full inertial reaction of a real round enhances the simulation of firing a real round.

As an additional training feature, an element of targeting and aiming adjustment experience can be added by a variant on the round as described. This can be effected by incorporating a smaller "marking" projectile within the sleeve, to be released upon the rupture of the sleeve wall.

Such a projectile may be of reduced mass and may have a non-streamlined form to limit its range. With these features present, training can be effected within a much smaller territory that would be required with full, regular rounds.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 1:
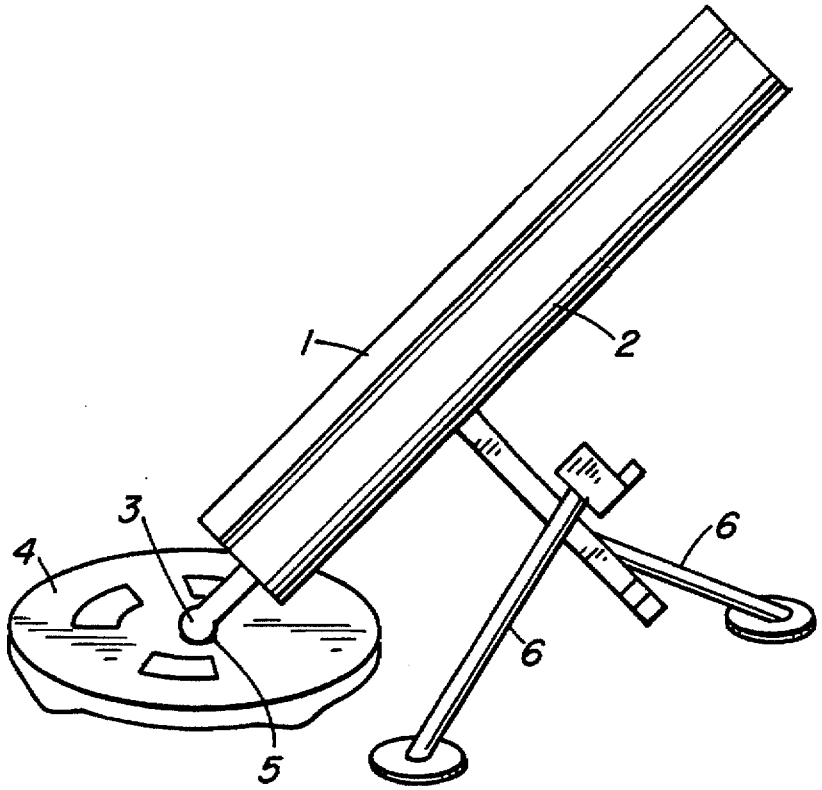
PRIOR ART FIG. 1
FIG. 1 is a pictorial depiction of a prior art mortar.

In FIG. 1 a standard 81 mm field mortar 1 is depicted. A barrel 2 having a breech plug 3 extension at its lower end mounts on a base plate 4 with the ball-shaped end of the breech plug 3 fitted into a socket 5 within the base plate 4. Struts 6 extend downwardly from the barrel 2 to the ground to maintain the elevation of the mortar 1.

Figure 2:
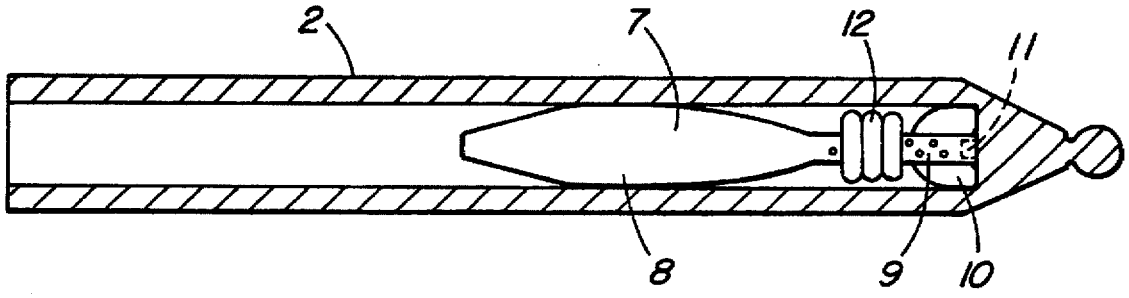
PRIOR ART FIG. 2
FIG. 2 is a cross-sectional view of a prior art mortar barrel with a prior art round therein.

FIG. 2 depicts a standard mortar round 7 positioned within a barrel 2 prior to firing. The round has a body 8 mounted on a perforated ignition tube 9 carrying fins 10 and a primer 11. Propellant 12 in the form of donut-shaped rings is positioned around the ignition tube just before firing. The tube 9, fins 10 and primer 11 comprise a launching means that is combined with the propellant to provide a propulsion system.

The diameter of the body 8 customarily is nearly equal to the bore of the barrel, e.g. 81 mm., allowing only for a small space for air to escape as the round is slid down the barrel.

Figure 3:
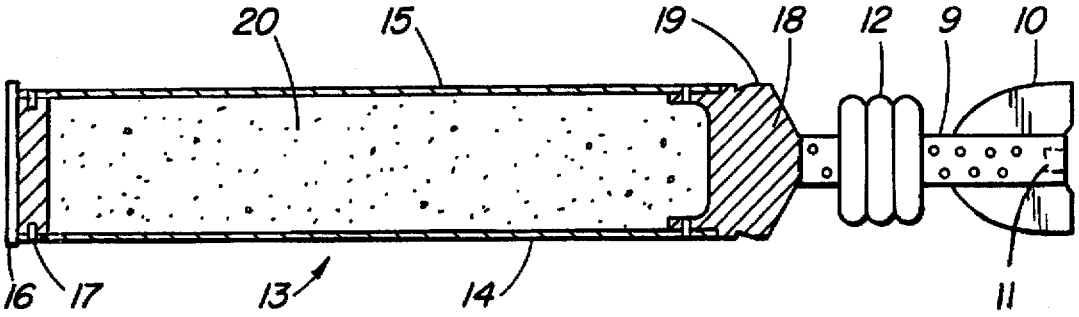
FIG. 3 is a cross-sectional view of the bedding or training round of the invention.

In FIG. 3, the mortar bedding round of the invention is depicted. It incorporates a canister 13 having a sleeve 14 having a sidewall 15. The forward end of the canister 13 is closed by a cap 16 shown attached by screws 17. However, other attachment means, as by crimping or glue bonding, may be employed for this capping means.

The rearward end of the canister 13 terminates at a seat 18 similarly attached to the sleeve sidewall 15. The seat has a diameter portion 19 nearly equal in dimension to the bore of a mortar barrel 2, but providing the gap necessary for air to escape upon loading of the round into a mortar barrel.

Within the canister 13 is a dispersible filling 20. This filling 20 may consist of or comprise finely divided particles of a heavy substance such as iron, other metallic powder, or clay. It may also consist of or comprise a liquid. The amount of filling 20 is chosen to provide the bedding round 13 with a mass equivalent to that of a regular round 7.

Figure 5:
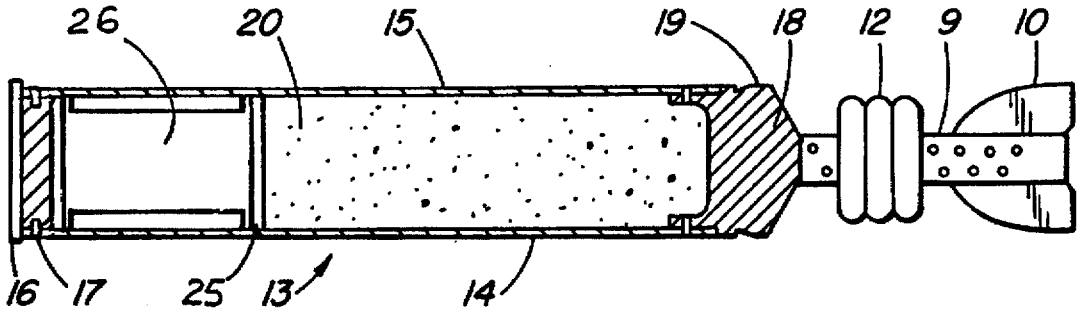
FIG. 5 is a cross-sectional view of the mortar round of FIG. 3 with a light weight marking projectile contained therein.

While shown as occupying the entire interior of the canister 13, the filling 20 may also leave space for an air gap 25 shown in FIG. 5, in conjunction with a marking projectile 26.

Fitted to the seat 18 are the ignition tube 9, fins 10, primer 11 constituting a launching means, and the propellant 12 of a normal round 7 to provide a full propulsion system. While it is not essential for these elements to be similar to those on a regular round 7, it is desirable to simulate a regular round 7 for realism in training. If such realism is not required, then alternate means for propelling the canister 13 may be provided. For use in bedding a mortar base 4 it is sufficient to provide any type of propulsion system for launching the canister 13.

The sleeve sidewall 15 may be formed of any material which will weaken on firing sufficiently to rupture when the round leaves the mortar barrel. Spirally wrapped paper 21 has been found suitable for this purpose. Cardboard, plastic film or other forms of sheeting that perform equivalently may also be employed.

The sleeve sidewall 15 may be dimensioned to permit it to expand on firing, due to the inertial pressure arising within the filling, thereby weakening the sidewall 15. The sleeve 14 in such case is arranged to have a diameter that provides an expansion gap suited to producing the requisite degree of expansion. A gap on the order of 1 millimetre of free-play in the mortar barrel, combined with the use of cardboard in the sidewalls 15, has been found suitable.

Figure 4:
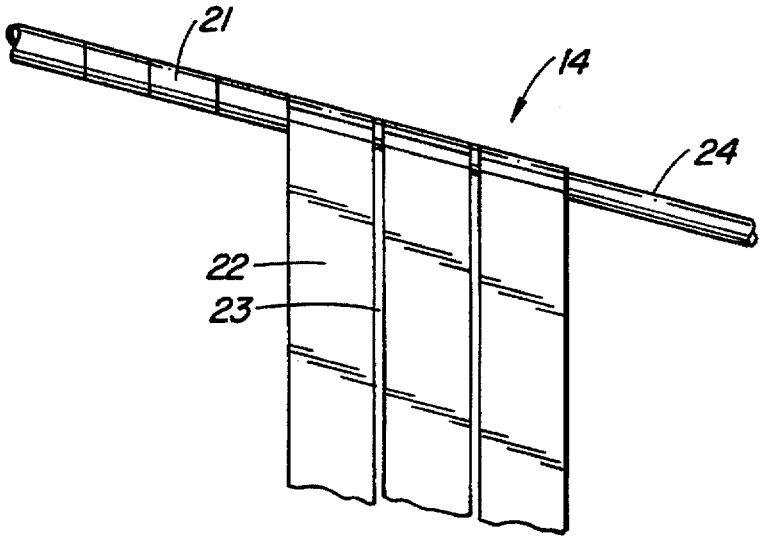
FIG. 4 is a pictorial view of a spiral tube being formed by winding strips of paper that have a gap therebetween.

FIG. 4 shows the production of a paper sleeve wall 14 from the first of several overlying strips of paper 22 that are being spirally bonded with one or more bonding agents in layers as they are being wrapped on a mandrel 24. Gaps 23 may be left between strips to provide weak points that fail upon firing. Failure can occur by tearing of the paper or by separation of the paper layers. By choosing to overlie such gaps 23 with further paper strips 22 of selected thickness and widths, the vulnerability of the sleeve sidewall 15 to failure can be controlled. Multiple layers of varying widths may be employed with gaps that are aligned or displaced from each other in order to control the strength and bursting characteristics of the sidewall 15.

In this manner the filling 20 can be kept integral while the canister 13 is inside the barrel 2, but be released for dispersal once the canister sidewall 15 has ruptured, after the canister 13 leaves the barrel 12.

As a further variant of the invention shown in FIG. 5 the filling 20 may be limited in quantity to provide an air gap 25 within the canister 13. A marking projectile 26 of reduced weight may be placed within the canister 13, preferably at its forward end. By using a marking projectile 26 of reduced weight, and optionally an inefficient aerodynamic shape, the range of such marking projectile can be limited. This allows for training that includes aiming practice to occur within a smaller test area.

Conclusion

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property are claimed as follows:

1. A mortar round for firing from a mortar having a mortar barrel with a muzzle, said round comprising:

(1) launching means for launching said round;

(2) a seat for carrying a containment canister mounted on said launching means;

(3) said containment canister mounted on said seat, said canister comprising a sleeve with a sleeve sidewall;

(4) a capping means for sealing said sleeve positioned at the end of said sleeve opposite to said seat; and (5) a flowable filling having mass positioned within said sleeve wherein:

(a) the mass of said filling is sufficient to effect recoil of the mortar upon firing; and (b) said sleeve sidewall has a reduced strength portion that, upon firing of the mortar, will be sufficiently weakened by said firing as to continue to contain said filling while Said sidewall is within said barrel but rupture upon leaving the muzzle of said mortar barrel thereby releasing the filling for dispersion into the surrounding space and thereby simulating the firing of a live round.

2. A mortar round as in claim 1 wherein said sleeve sidewall is provided by wound paper strips, bonded together in layers by one or more bonding agents, said reduced strength portion of said sidewall being provided between said bonded layers.

3. A mortar round as in claim 2 in combination with said mortar having said barrel, the diameter of the sleeve of the round differing from the diameter of the mortar barrel by an expansion gap into which the sleeve may expand upon firing.

4. A mortar round as in claim 1 wherein said sleeve sidewall is provided by wound paper strips, said paper strips being wound in multiple, overlapping layers with a gap present within at least one of said layers to provide a failure path in said sidewall constituting said reduced strength portion.

5. A mortar round as in claim 4 in combination with said mortar having said barrel, the diameter of the sleeve of the round differing from the diameter of the mortar barrel by an expansion gap into which the sleeve may expand upon firing.

6. A mortar round as in claim 1 wherein said sleeve has thinned grooves in said sidewall to be ruptured upon firing of said mortar round.

7. A mortar round as in claim 6 in combination with said mortar having said barrel, the diameter of the sleeve of the round differing from the diameter of the mortar barrel by an expansion gap into which the sleeve may expand upon firing.

8. A mortar round as in claim 6 wherein the mass of said filling is sufficient to bed a mortar round upon firing.

9. A mortar round as in claim 1 wherein the sleeve is smaller in diameter than the bore of the mortar barrel in which it is to be fired and said reduced strength portion is sufficiently weakened so as to permit said sidewall to expand slightly within said mortar barrel during firing, to the limit of said bore diameter, while continuing to contain said filling while the round is within said mortar barrel but rupturing after leaving said muzzle.

10. A mortar round as in claim 9 wherein the sleeve sidewall has sufficient integrity upon leaving said muzzle to avoid immediate rupture, but is sufficiently weak to rupture from air pressure arising from its motion through the air.

11. A mortar round as in claim 9 wherein the filling occupies only a filled portion of the volume of the sleeve, and said sleeve sidewall is weakened upon firing principally around said filled portion.

12. A mortar round as in claim 11 containing additionally a marking projectile within said sleeve.

13. A mortar round as an claim 12 in combination with said mortar having said barrel, the diameter of the sleeve of the round differing from the diameter of the mortar barrel by an expansion gap into which the sleeve may expand upon firing.

14. A mortar round as in claim 11 wherein the mass of said filling is sufficient to bed a mortar round upon firing.

15. A mortar round as in claim 1 wherein the filling is selected from the group of materials constituted by metallic powder, iron powder, iron filings, a liquid, water and powdered clay.

16. A mortar round as an claim 15 in combination with said mortar having said barrel, the diameter of the sleeve of the round differing from the diameter of the mortar barrel by an expansion gap into which the sleeve may expand upon firing.

17. A mortar round as in claim 1 wherein the launching means comprises:

(1) an ignition tube;

(2) a primer receptacle at an access to the ignition tube;

(3) guidance fins coupled to the ignition tube (4) propellant mounted on said ignition tube.

18. A mortar round as in claim 17 in combination with said mortar having said barrel, the diameter of the sleeve of the round differing from the diameter of the mortar barrel by an expansion gap into which the sleeve may expand upon firing.

19. A mortar round as in claim 1 in combination with said mortal having said barrel, the diameter of the sleeve of the round differing from the diameter of the mortar barrel by an expansion gap into which the sleeve may expand upon firing.

20. A mortar round as in claim 1 wherein the mass of said filling is sufficient to bed a mortar upon firing.

* * * * *